US006571541B1

(12) United States Patent
Rees

(10) Patent No.: US 6,571,541 B1
(45) Date of Patent: Jun. 3, 2003

(54) BILLET STRAP WITH STRETCH FEATURE

(75) Inventor: Daniel A. Rees, Tenino, WA (US)

(73) Assignee: Cashel Farms, L.L.C., Onalaska, WA (US)

( * ) Notice: Subject to any disclaimer, the term of this patent is extended or adjusted under 35 U.S.C. 154(b) by 0 days.

(21) Appl. No.: 09/735,000

(22) Filed: Dec. 11, 2000

Related U.S. Application Data

(60) Provisional application No. 60/180,008, filed on Feb. 3, 2000.

(51) Int. Cl.[7] ..... B68C 1/00
(52) U.S. Cl. ..... 54/23; 54/69
(58) Field of Search ..... 54/23, 69, 87, 54/46.1; D30/137

(56) References Cited

U.S. PATENT DOCUMENTS

| | | | | | |
|---|---|---|---|---|---|
| 262,053 | A | * | 8/1882 | King | 54/23 |
| 299,995 | A | * | 6/1884 | McGuire | 54/23 |
| 370,208 | A | * | 9/1887 | Pefley | 54/23 |
| 1,531,672 | A | * | 3/1925 | McLean | 54/46.1 |
| 2,066,855 | A | * | 1/1937 | Robertson | 54/23 |
| 3,807,135 | A | | 4/1974 | Leiderman | 54/23 |
| 3,828,521 | A | | 8/1974 | Dulaney | 54/23 |
| 4,132,055 | A | | 1/1979 | Bird | 54/23 |
| 4,187,663 | A | | 2/1980 | LaCroix, Jr. | 54/23 |
| 4,434,604 | A | | 3/1984 | Bird | 54/23 |
| 4,570,424 | A | | 2/1986 | Simpson | 54/23 |
| 4,709,539 | A | | 12/1987 | Bird | 54/23 |
| 4,821,380 | A | | 4/1989 | Crosby | 54/23 |
| 4,905,458 | A | | 3/1990 | Johnston et al. | 54/23 |
| 4,999,980 | A | | 3/1991 | McGowan | 54/23 |
| 5,031,387 | A | | 7/1991 | Rider | 54/23 |
| 5,125,219 | A | | 6/1992 | Sligo | 54/23 |
| 5,226,282 | A | | 7/1993 | Meyers | 54/23 |
| 5,426,924 | A | | 6/1995 | Harty | 54/23 |
| 5,566,533 | A | | 10/1996 | Larisch | 54/23 |
| 5,743,072 | A | | 4/1998 | Chang | 54/23 |
| 5,768,864 | A | * | 6/1998 | Chang | 54/23 |
| 5,816,031 | A | | 10/1998 | Marshall | 54/23 |
| 5,946,892 | A | | 9/1999 | Siddoway | 54/23 |

* cited by examiner

*Primary Examiner*—Charles T. Jordan
*Assistant Examiner*—Elizabeth Shaw
(74) *Attorney, Agent, or Firm*—Christensen O'Connor Johnson Kindness PLLC

(57) ABSTRACT

A billet strap for use with a Western saddle includes a portion of stretch material in the construction of the billet strap. The stretch material allows the billet strap to adjust and fine tune the tension of a cinch when the billet strap is used to connect the cinch to the Western saddle, thus increasing the comfort of the horse. In one exemplary embodiment, the billet strap is comprised of a portion of nonstretching material joined in series with a portion of stretching material. The billet strap may include a protective sleeve. The protective sleeve may cover all or only a portion of the billet strap. In other embodiments of the invention, the billet strap is comprised of multiple portions of material (e.g., three nonstretching portions joined together by two stretching portions). In yet another embodiment, the billet strap is comprised entirely of a stretching material.

20 Claims, 6 Drawing Sheets

BILLET STRAP WITH STRETCH FEATURE

RELATED APPLICATION

The benefit of the filing date of U.S. Provisional Patent Application No. 60/180,008, filed Feb. 3, 2000, is hereby claimed for this application under 35 U.S.C. § 119(e).

FIELD OF THE INVENTION

The present invention relates generally to saddlery, and more particularly to billet straps for use with a cinch in securing a Western saddle to a horse.

BACKGROUND OF THE INVENTION

In the horse industry, a girth is distinguished from a cinch. A girth is a "belly band" that attaches to an English saddle, while a cinch attaches to a Western saddle. English saddles and Western saddles (i.e., "cowboy" saddles having a horn used for roping) are distinctly different in shape, construction, and use.

A Western saddle is secured to a horse by passing a cinch under the belly of the horse and attaching the cinch to the saddle. A billet strap is an optional accessory that can be used to connect a cinch to a Western saddle.

A billet strap is typically looped through a D-ring attached to a Western saddle and connects a cinch to the saddle by way of a buckle on the cinch. Most billet straps have a series of holes defined therein to receive the tongue of the buckle on the cinch. In some configurations, billet straps may be formed from multiple straps that attach to one or more D-rings on the saddle.

Historically, a cinch was tied to the D-ring on the offside of a Western saddle (i.e., the horse's right side), passed under the belly, and tied to the D-ring on the nearside of the saddle (i.e., the horse's left side). The advent of billet straps for connecting a cinch to a Western saddle eliminated the need for the offside knot, which can be bulky under a rider's leg, potentially uncomfortable for the horse, and possibly painful girth galls. Billet straps, nevertheless, remains an optional feature as a buckled cinch can still be tied to the offside saddle D-ring.

Billet straps are typically made of leather, though they can be made of other materials such as nylon. While the series of holes in a billet strap allows a horse rider to somewhat adjust the fit of the cinch to the horse (i.e., adjust how tight the cinch is secured to the horse), a rider may still be required to readjust the tension of the cinch during a ride to accommodate shifting in the position of the saddle and/or cinch. Typically, the tension of the cinch is adjusted during the ride by having to get off the horse and tighten the nearside knot (latigo). A cinch that is too tight may be uncomfortable for the horse and potentially restrict its breathing and/or performance to a degree, while a cinch that is too loose does not securely hold the saddle to the horse. There is a need, therefore, for a billet strap that automatically and more finely adjusts the tension of a cinch, which increases the comfort for a horse. The present invention is a billet strap that addresses this need without requiring riders to change the type of cinch they are currently using.

SUMMARY OF THE INVENTION

The present invention is an improved billet strap that includes a portion of stretch material that allows the billet strap to adjust and maintain the tension of a cinch (which should increase the comfort of the horse) when the billet strap is used to connect the cinch to a Western saddle. In one embodiment, the billet strap is comprised of two portions made of a nonstretching material joined together by a portion made of a stretching material. The stretching material has a higher degree of elasticity than the nonstretching material, and may be covered by a protective sleeve. The protective sleeve may cover all or only a portion of the billet strap. In another embodiment, the billet strap is comprised of multiple nonstretching portions joined together by stretching portions. In yet another embodiment, the billet strap is comprised entirely of a stretching material. In still another embodiment, the billet strap is comprised of a portion of stretching material connected to a portion of nonstretching material.

BRIEF DESCRIPTION OF THE DRAWINGS

The foregoing aspects and many of the advantages of this invention are more readily appreciated as the same become better understood by reference to the following detailed description, when taken in conjunction with the accompanying drawings, wherein.

DETAILED DESCRIPTION OF THE PREFERRED EMBODIMENT

Figure 1:
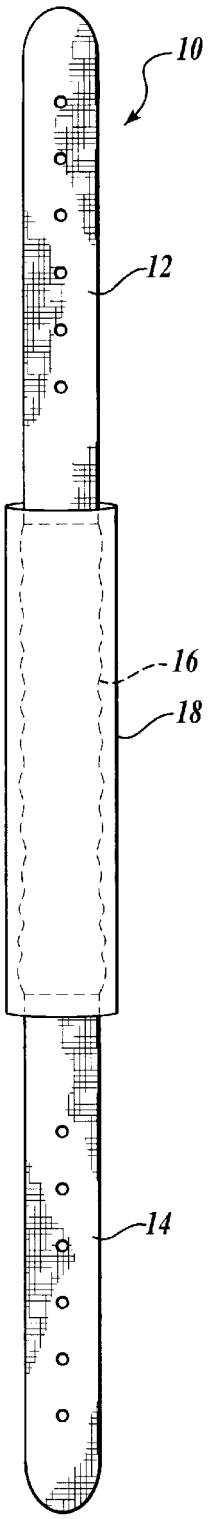
FIG. 1 illustrates one embodiment of a billet strap constructed in accordance with the present invention comprised of two nonstretch portions and a stretch portion with an accompanying protective sleeve around the stretch portion.

FIG. 1 illustrates one embodiment of a billet strap 10 constructed in accordance with the present invention. The billet strap 10 is comprised of two portions 12 and 14 formed of a nonstretch material, and a portion 16 formed of a stretch material. The nonstretch portions 12 and 14 are comprised of an appropriate high-strength material, including but not limited to leather, nylon, or plastic. The stretch portion 16 is comprised of a stretch material including, but not limited to, an elastic or other elastomeric material. One end of the stretch portion 16 is sewn, riveted, or otherwise secured to the nonstretch portion 12, while the other end of the stretch portion 16 is secured to the nonstretch portion 14, thus joining the nonstretch portions 12 and 14 in series to form the billet strap 10.

The stretch portion 16 has a higher degree of elasticity than the nonstretch portions 12 and 14. In other words, when a pulling force is applied to the ends of the billet strap 10, the stretch portion 16 exhibits a greater elongation per unit length than the nonstretch portions 12 and 14. One suitable measure of a material's degree of elasticity is provided by the material's "modulus of elasticity" (which in terms of value appears inversely proportional to the material's degree of elasticity). The higher the modulus of elasticity, the lower the degree of elasticity (i.e., the stiffer the material). References to "stretch" material in the description of the invention herein (such as that used to form portion 16) signify that the material has a higher degree of elasticity than the "nonstretch" material (such as that used to form portions 12 and 14).

As will be understood from the description herein, the stretch material in portion 16 allows the billet strap 10 to "give" as the horse breathes and moves, which provides greater comfort for the horse. At the same time, the elastic tension in the stretch portion 16 provides an automatic fine adjustment of the overall tension of a cinch connected by the billet strap 10 to a Western saddle. The adjustment of tension that results from the elastic quality of the stretch material may help reduce the need for adjustments of the cinch's tension during a ride.

The billet strap 10 shown in FIG. 1 also includes a protective sleeve 18 that surrounds and protects all or a portion of the billet strap 10 (e.g., the stretch portion 16). The protective sleeve 18 shown in FIG. 1 slides longitudinally along the length of the billet strap 10. In alternative embodiments of the billet strap 10, the sleeve 18 may be attached by a rivet, sewing, or other fastening means, to either of the nonstretch portions 12 or 14, or to the stretch portion 16, to keep the protective sleeve 18 in place around the billet strap 10. The protective sleeve 18 is preferably formed of an appropriate wear-resistant and sweat-resistant material such as leather, nylon, plastic, etc.

In use, one end of the billet strap 10 is fed through a D-ring attached to the side of a Western saddle. The billet strap 10 is fed through the D-ring until the D-ring is located approximately in the middle of the stretch portion 16 (and the protective sleeve 18, if present). The billet strap is then folded around the D-ring, and the two ends of the billet strap are fed through a buckle in a cinch that runs under the belly of the horse. The elastic tension of the stretch material in the stretch portion 16 helps regulate the tension of the billet strap, and hence the tension of the cinch. As shown in FIG. 1, the nonstretch material in portions 12 and 14 is perforated with holes or apertures through which the tongue of the cinch buckle is passed to secure the cinch to the billet strap. In other embodiments of the invention, a cinching mechanism such as a clamp having a cam lock-type arrangement may be used to secure the cinch to the billet strap.

The protective sleeve 18 protects the stretch material 16 from wear and stress that occurs at the point of contact with the D-ring of the Western saddle. The protective sleeve 18 also protects the stretch material 16 from sweat on the horse and other environmental factors that may cause deterioration of the stretch material 16 before deterioration of the nonstretch material. Although the protective sleeve 18 is shown in FIG. 1 extending the entire length of the stretch portion 16, the protective sleeve 18 may be of shorter or longer length. If the protective sleeve has a shorter length (and thus does not entirely cover the stretch portion 16), the protective sleeve 18 is preferably allowed to slide along the length of the stretch portion 16 so that the protective sleeve 18 may be positioned inside the D-ring of the saddle when the billet strap 10 is folded over the D-ring.

Figure 2:
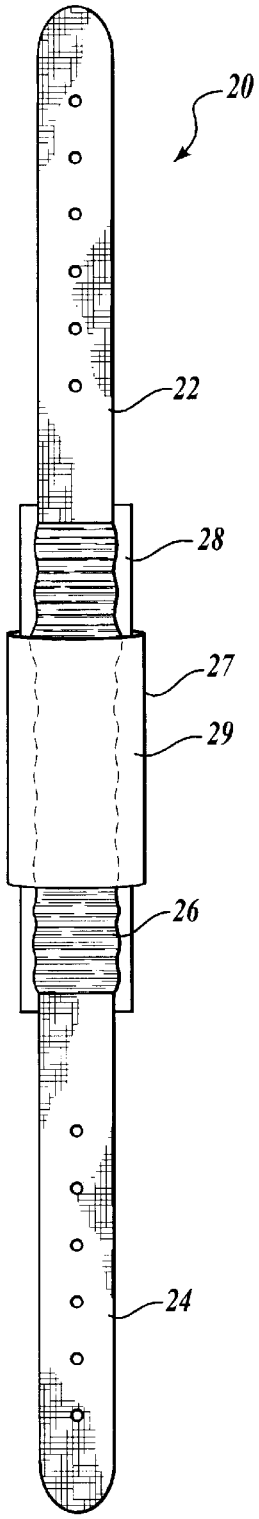
FIG. 2 illustrates another embodiment of a billet strap constructed in accordance with the present invention as shown in FIG. 1 with an alternative sleeve structure.

FIG. 2 illustrates another embodiment of a billet strap 20 constructed in accordance with the present invention. The billet strap 20 is of similar construction to the billet strap 10 shown in FIG. 1 in that the billet strap 20 is comprised of two nonstretch portions 22 and 24 joined together by a stretch portion 26. The principal difference of the billet strap 20 compared to the billet strap 10 is in the construction of the protective sleeve 27. The protective sleeve 27 is shown having a longer first portion 28 and a shorter second portion 29 connected to the first portion 28 in a concentric arrangement around the billet strap 20. The first portion 28 preferably extends the entire length of the stretch portion 26 to protect the stretch portion 26 from sweat and other environmental concerns. The shorter second portion 29 is positioned at the point where the billet strap 20 folds through the D-ring of the saddle to protect the stretch portion 26 from wear and stress occurring at this point of contact with the Western saddle. While the protective sleeve 27 shown in FIG. 2 may slide along the length of the billet strap 20, an alternative embodiment of the billet strap 20 may secure of the protective sleeve 27 to either of the nonstretch portions 22 or 24. The protective sleeve 27 may also be affixed to the stretch material 26, if desired.

Figure 3:
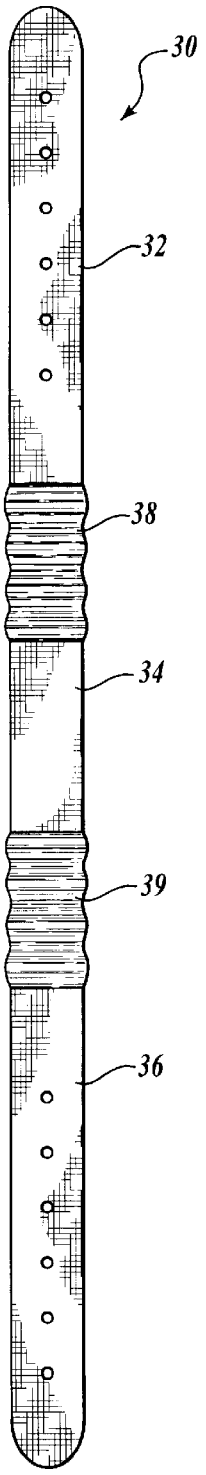
FIG. 3 illustrates another embodiment of a billet strap constructed in accordance with the present invention that includes three nonstretch portions and two stretch portions.

FIG. 3 illustrates yet another embodiment of a billet strap 30 constructed in accordance with the present invention. The billet strap 30 is comprised of three nonstretch portions 32, 34, and 36. The nonstretch portions 32 and 34 are joined together in series by a stretch portion 38, and the nonstretch portions 34 and 36 are joined together in series by a stretch portion 39. When the billet strap 30 is used in connection with a cinch and Western saddle, the nonstretch portion 34 is preferably disposed within the D-ring of the saddle to engage the D-ring when the billet strap 30 is connected to the cinch. The stretch portions 38 and 39 provide an elastic tension to the billet strap and cinch, while the nonstretch portion 34 bears the wear and stress that occur in the D-ring.

FIG. 3 also illustrates the optional nature of protective sleeves, such as sleeves 18 and 27 shown in FIGS. 1 and 2. While FIG. 3 illustrates the billet strap 30 without a protective sleeve, one or more protective sleeves nonetheless may be added to the billet strap 30 to cover and protect it. For example, protective sleeves used to cover the stretch portions 38 and 39 may be allowed to freely slide along the length of the billet strap 30, or may be secured to the billet strap 30 so that the protective sleeves remain disposed about the stretch portions 38 and 39.

Figure 4:
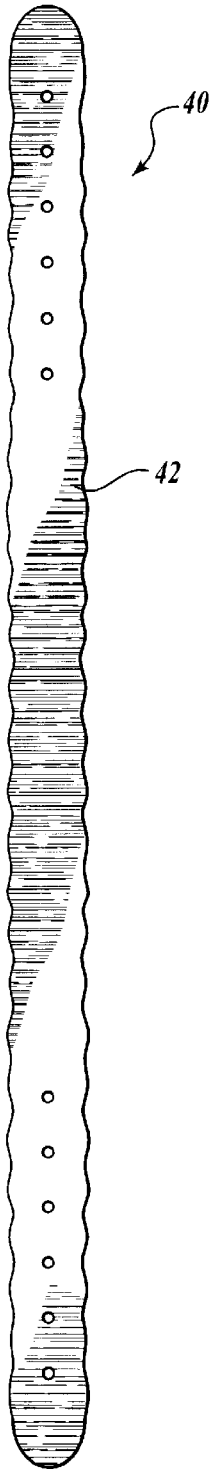
FIG. 4 illustrates yet another embodiment of a billet strap constructed in accordance with the present invention comprised entirely of a stretch material.

FIG. 4 illustrates yet another embodiment of a billet strap 40 constructed in accordance with the present invention. The billet strap 40 is comprised entirely of a stretch material 42. The stretch material 42 used in the billet strap 40 is not necessarily the same material used in the stretch portions 16, 26, 38, or 39 of billet straps 10, 20, or 30 described above. Preferably, the stretch material 42 used in billet strap 40 is highly durable and resistant to wear and stress, while at the same time provides an elastic tension that helps adjust the overall tension of the cinch when in use. In this regard, it is expected that the stretch material 42 used to form the billet strap 40 would have a higher degree of elasticity than leather as used in a standard all-leather billet strap. The billet strap 40, as with the other embodiments of the invention discussed and shown herein, includes holes or apertures through which the tongue of a buckle at the end of a cinch is passed to secure the billet strap 40 to the cinch, though such holes are not necessary. Other means for securing the cinch to the billet strap may be used, such as a mechanism that pinches or otherwise holds the cinch to the billet strap. The billet strap 40 may also include a protective sleeve as shown in FIGS. 1 and 2.

Figure 5:
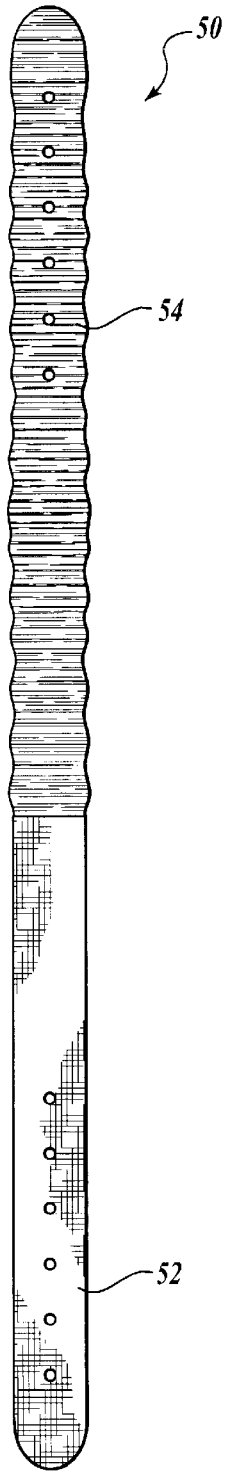
FIG. 5 illustrates still another embodiment of a billet strap constructed in accordance with the present invention comprised of a stretch portion and a nonstretch portion.

FIG. 5 illustrates still another embodiment of a billet strap 50 constructed in accordance with the present invention. The billet strap 50 includes a first nonstretch portion 52 and a second stretch portion 54 that is connected in series to the first nonstretch portion 52. As is understood with other embodiments of the invention, the material forming the stretch portion 54 has a higher degree of elasticity than the material forming the nonstretch portion 52. The stretch portion 54 provides an elastic tension to the billet strap 50 that helps adjust the overall tension of the cinch, when in use.

In FIG. 5, the nonstretch portion 52 is shown having a shorter length than the stretch portion 54. The material forming the nonstretch portion 52 (e.g., leather) will typically have higher durability and resistance to stress than the material forming the stretch portion 54 (e.g., an elastic). Nevertheless, since the stretch portion 54 engages the D-ring of the Western saddle and the buckle of the cinch when in use, the stretch material should be resistant to wear and stress, and may be formed of the same stretch material used to form the billet strap 40 shown in FIG. 4. Again, as with other embodiments of the invention, the billet strap 50 may also include a protective sleeve as shown in FIGS. 1 and 2.

Figure 6:
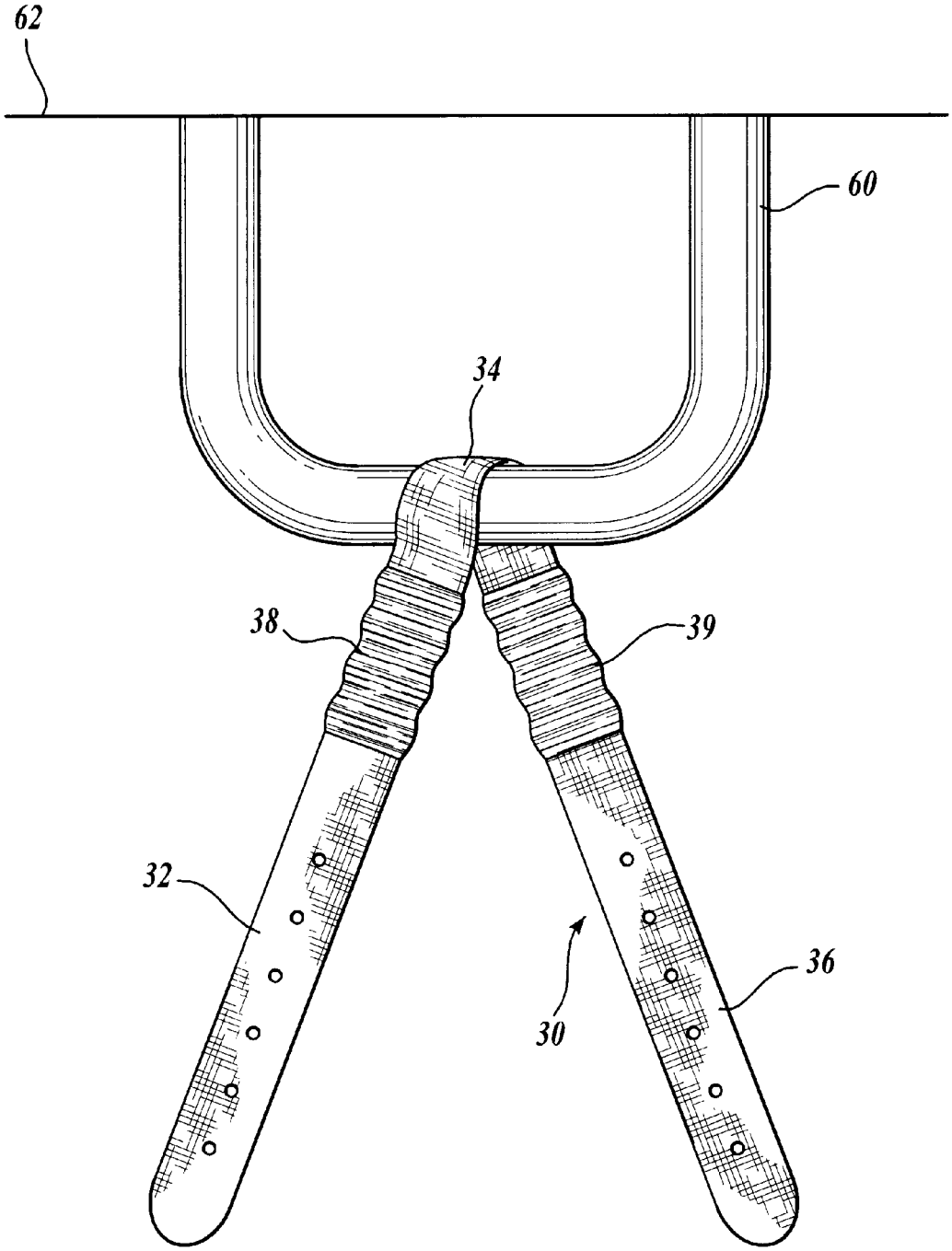
FIG. 6 illustrates an environment in which the billet strap shown in FIG. 3 may be used, wherein the billet strap is folded over a single D-ring.

FIG. 6 illustrates the billet strap 30 shown in FIG. 3 in one possible environment in which the billet strap may be used. In FIG. 6, the billet strap 30 is folded over a D-ring 60 attached to an edge 62 of a Western saddle. The billet strap 30 connects to a buckled cinch (not shown) by lining up the holes in the billet strap 30 and passing the tongue of the cinch's buckle through the holes.

Figure 7:
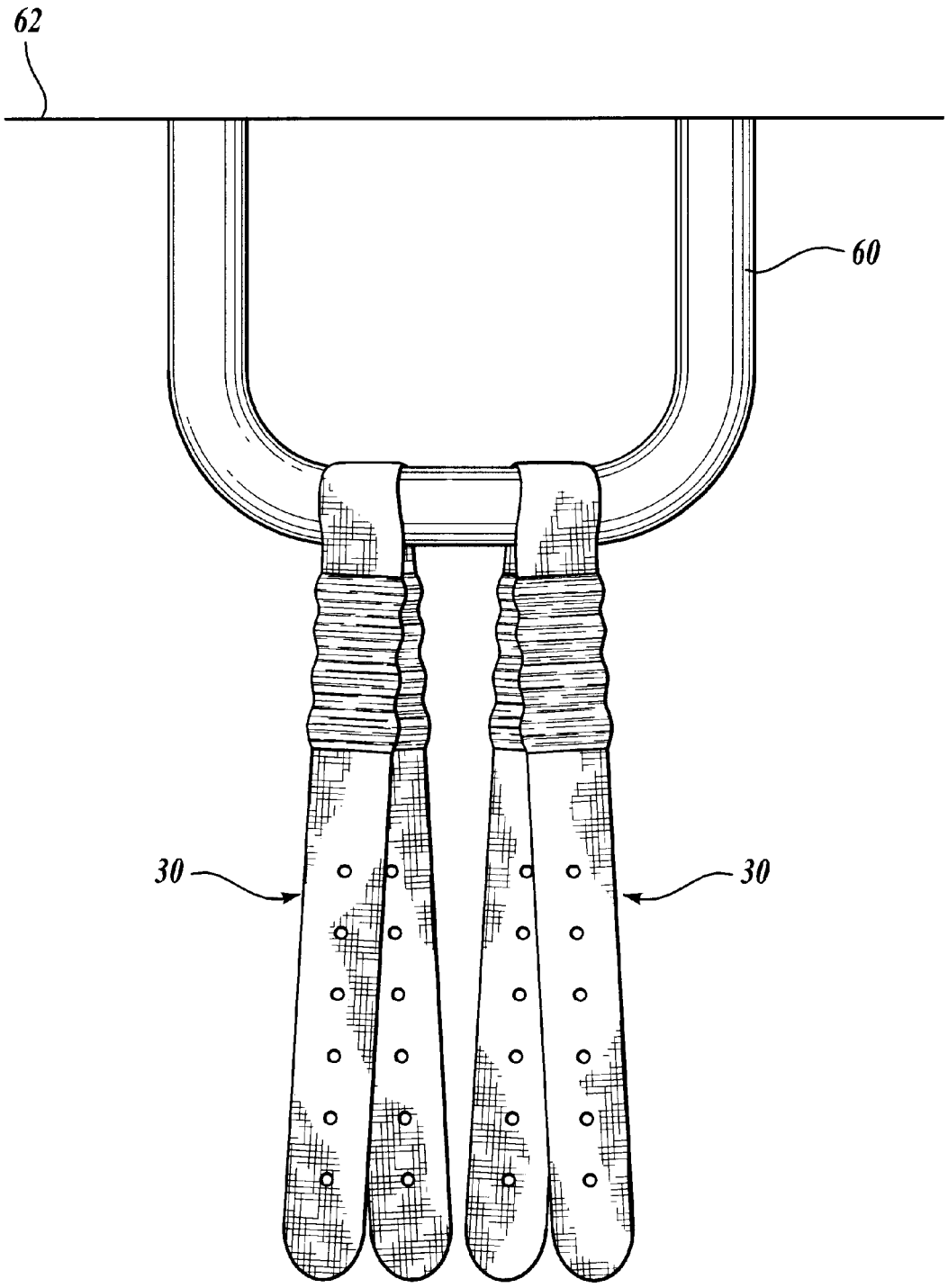
FIG. 7 illustrates another environment in which two billet straps, as shown in FIG. 3, are folded over a single D-ring.

FIG. 7 illustrates an alternative configuration in which two billet straps 30 are folded over the Western saddle D-ring 60. In this configuration, each of the billet straps 30 may be attached to separate buckles connected to the end of a cinch. Alternatively, a single billet strap 30, as shown in FIG. 6, may be used with a cinch that has more than one buckle at its end by attaching one end of the billet strap 30 to one of the cinch buckles and the other end of the billet strap 30 to another cinch buckle (with the middle of the billet strap 30 folded through the D-ring 60 as shown).

Figure 8:
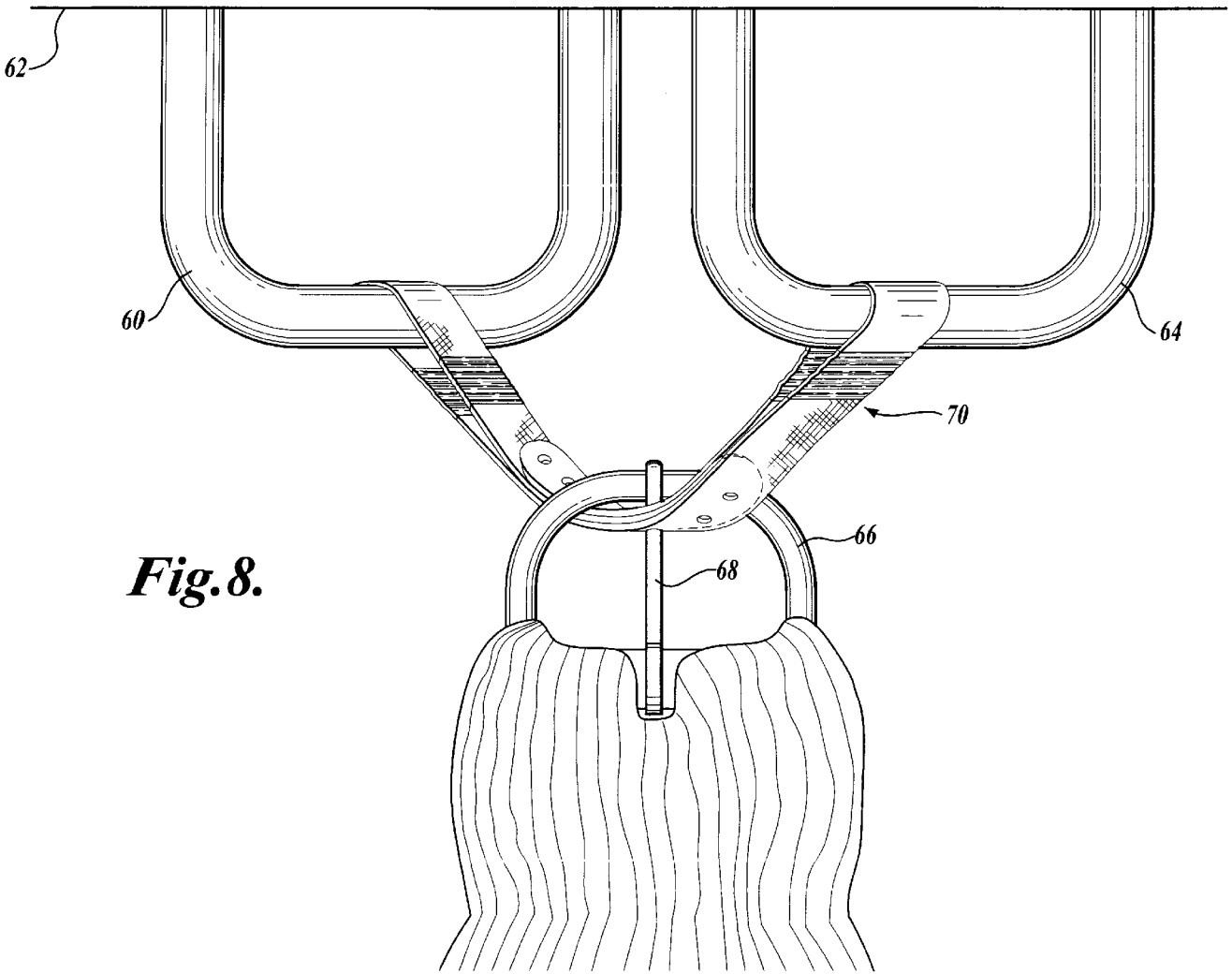
FIG. 8 illustrates another embodiment of a billet strap constructed in accordance with the present invention in an environment where the billet strap connects a cinch to a Western saddle having two D-rings.
Figure 9:
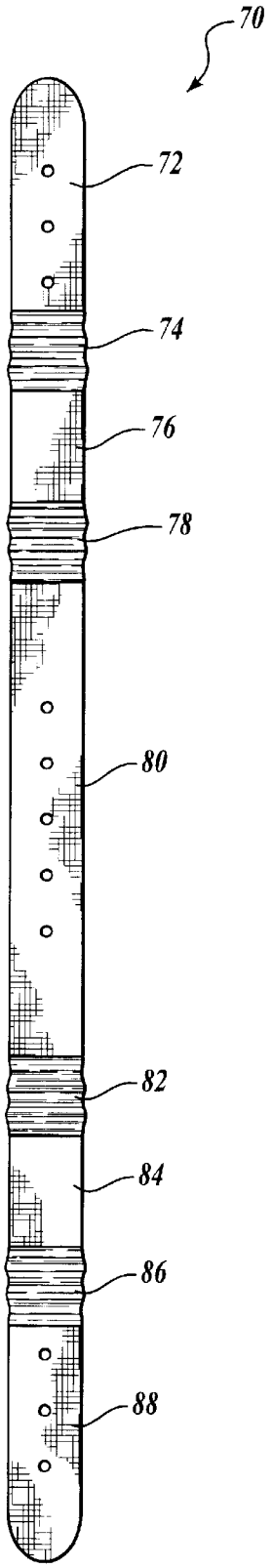
FIG. 9 illustrates the billet strap depicted in FIG. 8.

In yet another configuration, a Western saddle may have two D-rings 60 and 64 attached to an edge 62 of the Western saddle, as shown in FIG. 8. Where double D-rings are used on a Western saddle, a billet strap 70, as, shown in FIG. 9, may be used to attach a cinch to the Western saddle. The billet strap 70 shown in FIG. 9 is comprised of a plurality of nonstretch portions 72, 76, 80, 84, and 88 connected in series by stretch portions 74, 78, 82, and 86. The billet strap 70 includes a series of holes in the end nonstretch portions 72 and 88, as well as the middle nonstretch portion 80. In the manner depicted in FIG. 8, one end of the billet strap 70 may be doubled over the D-ring 60 (with the nonstretch portion 76 preferably located in the D-ring 60), the billet strap 70 being passed through the buckle 66 of a cinch, and the other end of the billet strap 70 being doubled over the D-ring 64 (with the nonstretch portion 84 preferably located in the D-ring 64). The holes in the end nonstretch portions 72 and 88 are lined up with the holes in the middle nonstretch portion 80 and the tongue 68 of the cinch is passed through the holes to secure the billet strap 70 to the cinch.

In an alternative arrangement, a cinch may be attached to a Western saddle with double D-rings 60 and 64, as shown in FIG. 8, using two billet straps, such as billet straps 30 shown in FIG. 3. In that regard, one billet strap 30 is doubled over the D-ring 60 while the other billet strap 30 is doubled over the D-ring 64. The end portions of the billet straps 30 are passed through the cinch buckle 66 and the holes in the end portions of the billet straps 30 are lined up for the tongue 68 of the cinch to pass therethrough.

While several embodiments of the invention have been illustrated and described, it will be appreciated that various modifications may be made therein without departing from the spirit and scope of the invention. For example, in the billet strap 30 shown in FIG. 3, the nonstretch portion 34 that engages the saddle's D-ring may be made of different material having a higher wear resistance, for example, than the nonstretch portions 32 and 36. In the billet strap 20 shown in FIG. 2, the shorter second portion 29 of the protective sleeve 27 may be comprised of a different material than that used to form the longer first portion 28. In this manner, the shorter second portion 29, which engages the D-ring, may be made of a material that is more resistant to wear from the D-ring, while the longer first portion 28 may be made of a material more resistant to sweat from the horse and other environmental factors. Billet straps constructed in accordance with the present invention provide horse riders using Western saddles greater control over the tension of the cinch, while at the same time providing greater comfort to the horse. The scope of the invention should therefore be determined in reference to the following claims and equivalents thereto.

The embodiments of the invention in which an exclusive property or privilege is claimed are defined as follows:

1. A billet strap for use in connecting a cinch to a Western saddle, the billet strap comprising at least a first portion of material connected in series to a second portion of material, the second portion of material having a higher degree of elasticity than the first portion of material to provide an automatic adjustment to the tension of the cinch when the billet strap connects the cinch to the Western saddle.

2. The billet strap according to claim 1, further comprising a protective sleeve disposed around the billet strap to protect the billet strap when the billet strap is secured to the Western saddle.

3. The billet strap according to claim 2, wherein the protective sleeve comprises a first portion and a second portion connected to the first portion, the second portion arranged concentric with the first portion around the billet strap.

4. The billet strap according to claim 3, wherein the second portion of the protective sleeve is shorter in length than the first portion of the protective sleeve.

5. The billet strap according to claim 3, wherein the second portion of the protective sleeve is made of a material more resistant to wear than the first portion of the protective sleeve.

6. The billet strap according to claim 2, wherein the protective sleeve is attached to at least one of the first or second portions of material forming the billet strap.

7. The billet strap according to claim 2, wherein the protective sleeve is positioned about the center of the longitudinal length of the billet strap.

8. The billet strap according to claim 1, further comprising a third portion of material connected in series to the second portion of material.

9. The billet strap according to claim 8, wherein the third portion of material has the same degree of elasticity as the first portion of material.

10. A billet strap for use in connecting a cinch to a Western saddle, the billet strap comprising a plurality of portions of material arranged longitudinally in a series, wherein each portion of material is connected to a neighboring portion of material in the series to form the billet strap, and wherein at least one portion of material in the plurality of portions has a higher degree of elasticity than one or more of the other portions of material.

11. The billet strap according to claim 10, further comprising a protective sleeve disposed around the billet strap to protect the billet strap when the billet strap is secured to the Western saddle.

12. The billet strap according to claim 11, wherein the protective sleeve is attached to at least one portion of material in the plurality of portions.

13. The billet strap according to claim 11, wherein a portion of the protective sleeve is shorter in length than the remainder of the protective sleeve.

14. The billet strap according to claim 13, wherein the shorter portion of the protective sleeve is made of a material more wear resistant than the remainder of the protective sleeve.

15. The billet strap according to claim 10, wherein the plurality of portions is comprised of a first, second, and third portion of material, and wherein the second portion of material has a higher degree of elasticity than the first and third portions of material.

16. The billet strap according to claim 15, further comprising a protective sleeve disposed around at least one of the first, second, and third portions to protect the billet strap when the billet strap is secured to the Western saddle.

17. The billet strap according to claim 16, wherein the protective sleeve is attached to one of the first, second, or third portions of material forming the billet strap.

18. The billet strap according to claim 15, further comprising a fourth and fifth portion of material connected in series with first, second, and third portions of material, wherein the fourth portion of material has a higher degree of elasticity than the first, third, and fifth portions.

19. The billet strap according to claim 18, wherein the third portion of material has a higher wear resistance than the first and fifth portions of material.

20. A billet strap for use in connecting a cinch to a Western saddle, the billet strap being formed of a strip of material having a first end and a second end, wherein the second end is unconnected and remote from the first end and not in an endless loop, wherein the strip of material is comprised of a stretch material that provides an elastic tension to the billet strap that automatically adjusts the tension of the cinch when the billet strap connects the cinch to the Western saddle.

* * * * *